US007594973B2

(12) United States Patent
Takahashi et al.

(10) Patent No.: US 7,594,973 B2
(45) Date of Patent: Sep. 29, 2009

(54) TITANIUM MATERIAL LESS SUSCEPTIBLE TO DISCOLORATION AND METHOD FOR PRODUCTION THEREOF

(75) Inventors: Kazuhiro Takahashi, Hikari (JP); Teruhiko Hayashi, Hikari (JP); Michio Kaneko, Futtsu (JP); Kiyonori Tokuno, Tokyo (JP); Junichi Tamenari, Hikari (JP); Kinichi Kimura, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/343,168

(22) PCT Filed: Jul. 19, 2001

(86) PCT No.: PCT/JP01/06302

§ 371 (c)(1),
(2), (4) Date: Jan. 27, 2003

(87) PCT Pub. No.: WO02/10481

PCT Pub. Date: Feb. 7, 2002

(65) Prior Publication Data

US 2003/0178112 A1 Sep. 25, 2003

(30) Foreign Application Priority Data

Jul. 28, 2000 (JP) ..... 2000-229803

(51) Int. Cl.
*C22C 14/00* (2006.01)

(52) U.S. Cl. ..... 148/421; 148/669

(58) Field of Classification Search ..... 148/421, 148/669

See application file for complete search history.

(56) References Cited

U.S. PATENT DOCUMENTS 5,603,338 A * 2/1997 Beaty ..... 128/898

FOREIGN PATENT DOCUMENTS

| | | |
|---|---|---|
| EP | 1264913 A1 * | 12/2002 |
| JP | 54-061038 | 5/1979 |
| JP | 59-179791 | 10/1984 |
| JP | 60-238465 | 11/1985 |
| JP | 62-267458 | 11/1987 |
| JP | 08-239779 | 9/1996 |
| JP | 08-291397 | 11/1996 |
| JP | 08-296072 | 11/1996 |
| JP | 09-157872 | 6/1997 |
| JP | 10-8234 | 1/1998 |

(Continued)

OTHER PUBLICATIONS

English Language translation of JP 10-008234, Jan. 1998.*

(Continued)

*Primary Examiner*—Scott Kastler
(74) *Attorney, Agent, or Firm*—Kenyon & Kenyon LLP

(57) ABSTRACT

Titanium material less susceptible to discoloration and method for thereof are provided. Titanium materials less susceptible to discoloration in the atmosphere are obtainable by controlling the fluorine and carbon contents in the oxide film on the surface thereof and the thickness of the oxide film. Such titanium materials are obtainable by dissolving the surface thereof in an aqueous fluonitric acid solution with a nitric acid concentration of not higher than 80 g/l or heat-treating at between 300 and 900° C. in a vacuum or in an inert gas atmosphere of argon or helium after dissolving in the aqueous fluonitric acid solution.

2 Claims, 3 Drawing Sheets

FOREIGN PATENT DOCUMENTS

| | | | |
|---|---|---|---|
| JP | 10-096093 | | 4/1998 |
| JP | 2001348634 A | * | 12/2001 |

OTHER PUBLICATIONS

English language translation of JP 2001-348634A, Dec. 2001.*
English language translation of JP 2000-001729A, Jan. 2000.*
"Oxide Film Using Electrolytic Method", pp. 58-60, by N. Baba, Jul. 31, 1996 with partial English translation.
"Microbeam Analysis 1980", 15$^{TH}$ Annual Conference, D.B. Wittry, Editor, pp. 101-105, Aug. 1980.
"Titanium Japan" vol. 43, No. 4, pp. 239-246, Oct. 1995 with English translation.

* cited by examiner

TITANIUM MATERIAL LESS SUSCEPTIBLE TO DISCOLORATION AND METHOD FOR PRODUCTION THEREOF

FIELD OF THE INVENTION

This invention relates to titanium materials less susceptible to discoloration with time used for roofs, exterior walls and other exterior materials, monuments, railings, fences and other items that should not be unpleasant or offensive to view and methods for manufacturing such titanium materials.

BACKGROUND OF THE INVENTION

Because of superior resistance to atmospheric corrosion, titanium materials have been used for building roofs and exterior walls exposed to severe corrosive environments in, for example, coastal areas. While approximately ten years have passed since the use of titanium materials as building materials, no case of corrosion has been reported so far. Yet, discoloration unpleasant or offensive to view can happen during long use in some environments. Although discoloration can be controlled by chemically or mechanically reducing the subsurface, low efficiency and high costliness are the problems with roofs and other applications of large areas.

Although the cause of titanium discoloration has not been fully clarified, it has been pointed out that discoloration might possibly result from the adhesion of iron, carbon, silicon dioxide and some other substances in the atmosphere or the development of interference color through the thickness increase of titanium oxide film at the surface of titanium materials.

Japanese Provisional Patent Publication No. 8234 of 1998 discloses a method to reduce discoloration by using titanium materials having surface roughness of not greater than Ra 3 μm and oxide film thickness of not smaller than 20 angstrom. However, the same publication describes nothing about the carbon at the surface and other compositional features.

Japanese Provisional Patent Publication No. 1729 of 2000 discloses use of titanium materials having oxide film thickness of not greater than 100 angstrom and containing not more than 30 at % carbon at the surface. The description says that titanium materials of this type can be obtained by reducing a certain amount of the surface by pickling. However, there is no description of the composition and concentration of the pickling liquid and their influences. No description is given about the influence of fluorine at the surface, too.

Titanium materials are generally pickled with an aqueous solution (of fluonitric acid) containing approximately 10 to 50 g of hydrofluoric acid and approximately 100 to 200 g of nitric acid (approximately 5 to 10 times greater than the concentration of hydrofluoric acid) per liter.

In order to prevent discoloration of titanium materials, the inventors carefully studied influences of surface roughness, oxide film thickness and carbon content on discoloration by conducing surface analyses on discolored roof materials collected from various parts of Japan and accelerated discoloration tests. The investigation revealed that the inventions disclosed in Japanese Provisional Patent Publication No. 8234 of 1998 and No. 1729 of 2000 failed to sufficiently prevent discoloration. No sufficiently effective methods to prevent titanium discoloration in the atmosphere are present.

An object of this invention is to provide titanium materials less susceptible to discoloration that will remain undisfigured for a long time through the control of discoloration that is likely to occur on titanium materials used for roofs, walls and other building materials and methods for manufacturing such titanium materials.

Other objects of this invention are obvious from the following description.

SUMMARY OF THE INVENTION

The studies the inventors made on the influences of surface compositions on titanium discoloration and methods of manufacturing titanium materials based on the surface analyses on discolored titanium roofs collected from various parts of Japan and accelerated discoloration tests revealed that the presence of oxide films containing higher percentages of fluorine or carbon accelerates discoloration.

This invention provides the following titanium materials and methods for manufacturing them based on the above finding.

(1) A titanium material less susceptible to discoloration possessing a surface oxide film containing not more than 7 at percent fluorine.

(2) A titanium material less susceptible to discoloration possessing a surface oxide film containing not more than 7 at percent fluorine and not more than 20 at percent carbon.

(3) A titanium material less susceptible to discoloration possessing a surface oxide film not more than 120 angstrom in thickness and containing not more than 7 at percent fluorine.

(4) A titanium material less susceptible to discoloration possessing a surface oxide film not more than 120 angstrom in thickness and containing not more than 7 at percent fluorine and not more than 20 at percent carbon.

(5) A method for manufacturing titanium materials less susceptible to discoloration comprising dissolving the surface of titanium with an aqueous solution of hydrofluoric and nitric acids (fluonitric acid) containing not more than 80 g per liter of nitric acid.

(6) A method for manufacturing titanium materials less susceptible to discoloration comprising dissolving the surface of titanium with an aqueous solution of hydrofluoric acid and nitric acid and, then, heating in a vacuum or an atmosphere of inert gas, such as argon and helium, at a temperature between 300 and 900° C.

(7) A method for manufacturing titanium materials less susceptible to discoloration described in (5) or (6) comprising skinpassing, abrasive blasting or other surface properties adjusting or redressing process applied either before or after or both of dissolving with an aqueous solution of fluonitric acid or either before or after or both of heat treatment in a vacuum or in an atmosphere of inert gas, such as argon and helium.

The content of fluorine and carbon and the thickness of oxide film are derived from the distribution of composition in the direction of depth from the surface of titanium materials determined by Auger electron spectroscopy. The titanium materials as used here mean strips, sheets, pipes, bars, wires, and other formed products of pure titanium, typically for industrial use, and titanium alloys.

PREFERRED EMBODIMENTS OF THE INVENTION

Atmospheric environment varies among different areas such as coastal, industrial, rural and mountain areas. Even in the same area, some titanium materials are more susceptible to discoloration and some are less susceptible. To explore the influences of environment and material on titanium discoloration, the inventors conducted exposure tests and surface analyses on various titanium materials in several areas of Japan in different environments. Also, the inventors analyzed the surface of actually discolored titanium roofs.

Through these studies the inventors discovered that acid rain is a major environmental discoloration accelerating factor. The inventors devised an accelerated discoloration test to simulate the acid rain environment that evaluates the degree of discoloration by dipping the test specimen in an aqueous sulfuric acid solution of pH3 at 60° C. for several days and checks the color difference between before and after dipping. The inventors also confirmed that the orders of color discoloration (color difference) of the titanium materials subjected to the discoloration acceleration and exposure tests agree to each other.

Study on the material factor causing discoloration discovered that the composition of the oxide film at the surface of titanium materials has influences on discoloration. The lower the contents of fluorine and carbon in the oxide film and the thinner the oxide film, the lower the likelihood of discoloration. For example, acids as weak as acid rain cause no corrosion macroscopically. Microscopically, however, titanium or compounds containing titanium, though very small in quantity, elute at the outermost surface of titanium materials. It is considered that the eluted titanium forms oxide film through reaction with oxygen and moisture that shows as discoloration by light interference.

When the oxide film contains much fluorine or carbon, fluorine, carbon or compounds thereof lowers the action of the oxide film to control the elution of the base metal titanium, thereby facilitating the elution of titanium. Or, the presence of fluorine or carbon in the oxide film as easy-to-dissolve compounds with titanium facilitates the growth and discoloration of the titanium oxide film. Here, fluorine and carbon in the oxide film may possibly exist by itself or as compounds with titanium, hydrogen, oxygen, etc.

To make it difficult to cause titanium surface discoloration, therefore, it is desirable to form a pure and highly stable oxide film consisting of an oxide phase containing as little as possible fluorine, carbon and other impurities other than oxygen at the surface of titanium. Therefore, it is necessary to reduce the quantity of fluorine and carbon contained in the oxide film formed when titanium material is pickled with an aqueous solution containing fluoric acid.

Figure 1:
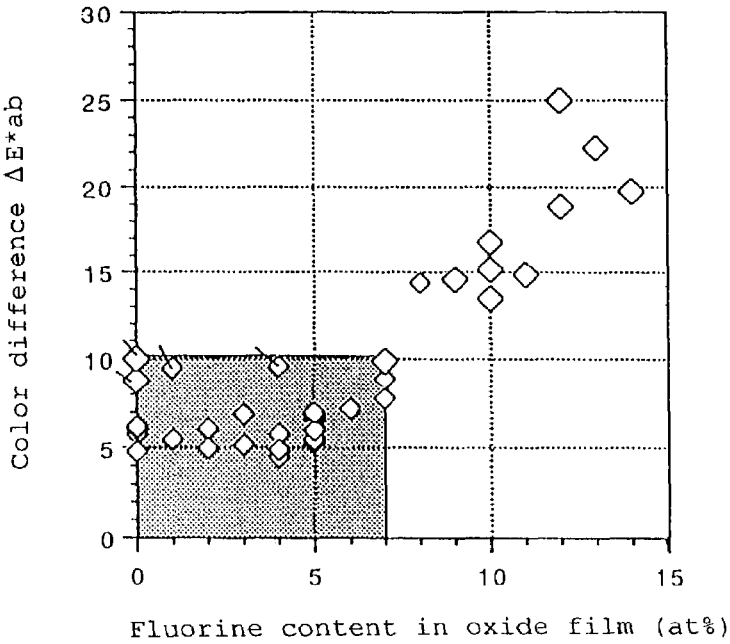
FIG. 1 shows the relationship between the fluorine content in the oxide film before accelerated discoloration test and the color difference ΔE*ab after the accelerated discoloration test.

FIG. 1 shows the relationship between the fluorine content in the oxide film on JIS Type 1 pure titanium for industrial use before the 7-day long accelerated discoloration test and the color difference ΔE*ab after the test. The symbol with a slash indicates a case in which carbon content in the oxide film exceeds 20 at %. As can be seen, the color difference is 10 points or under when fluorine content is 7 at % or under. Therefore, this invention specifies fluorine content in the surface oxide film to be 7 at % or under, or preferably 5 at % or less that makes color difference 7 points or under, as described in claim 1.

When color tones of titanium sheets before and after the discoloration test are compared, color tone difference is inconspicuous when color difference is less than 10 points. Color tone difference becomes more inconspicuous when color difference is less than 7 points. By contrast, color tone difference is conspicuous even at a distance when color difference is greater than 15 points.

Figure 2:
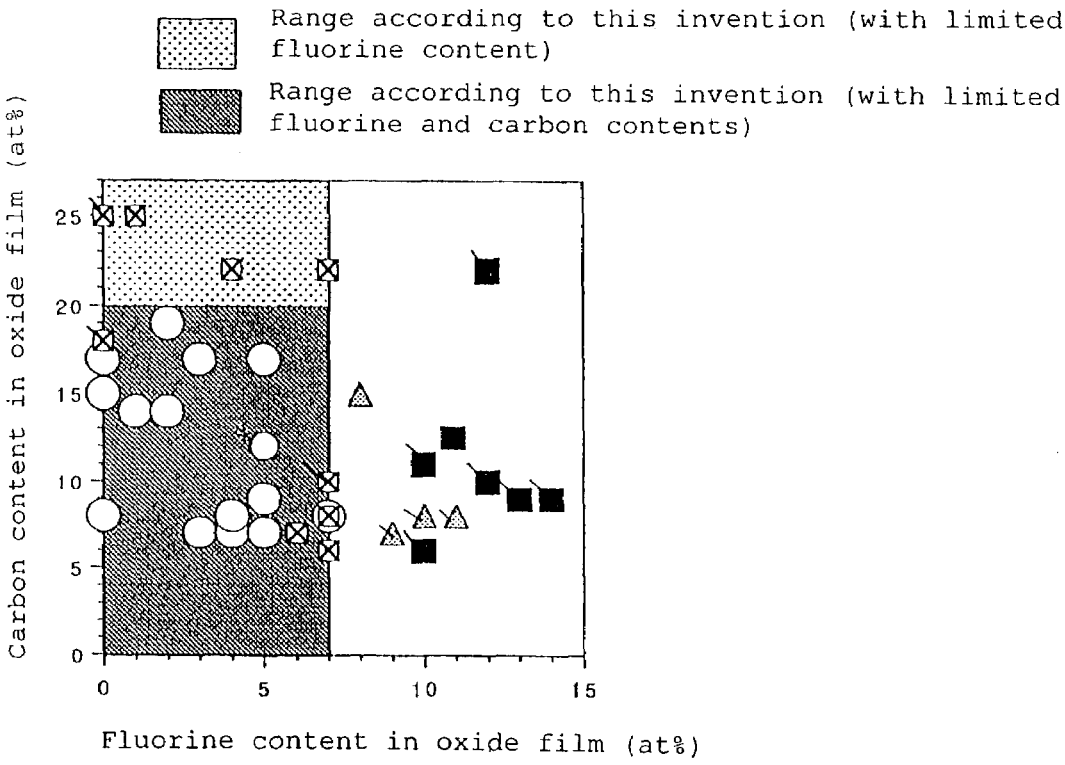
FIG. 2 shows the relationship between the range of the fluorine and carbon contents in the oxide film before accelerated discoloration test and the color difference ΔE*ab after the accelerated discoloration test.

FIG. 2 shows the relationship between the range of fluorine and carbon contents in the oxide film on JIS Type 1 pure titanium for industrial use before accelerated discoloration test and the color difference ΔE*ab after the 7-day long accelerated discoloration test. Color difference is shown in four levels: 7 points or below (circle), over 7 points and not more than 10 points (crossed square), over 10 points and under 15 points (black triangle) and 15 points or above (black square). The slash on the symbol shows that the oxide film is over 120 angstrom.

The dotted area in the figure shows the range in which fluorine content is specified according to this invention, whereas the black area shows the range in which fluorine and carbon contents are specified according to this invention.

When fluorine content is low, color difference is 10 points or below almost irrespective of carbon content. When carbon content is approximately 20 at % or below, color difference is always as low as 7 points or below. When fluorine content exceeds 7 at %, color difference is as great as over 10 points even if carbon content is low. Therefore, this invention specifies carbon content as 20 at % or below, in addition to the specification of fluorine content in the surface oxide film, as described in claim 2.

The accelerated discoloration test was carried out by dipping the specimen in an aqueous sulfuric acid solution at pH3 and 60° C. The color difference ΔE*ab indicating the degree of discoloration is expressed by color tones L*, a* and b* according to JIS Z8729. When the difference between before and after the accelerated discoloration test is expressed as ΔL*, Δa* and Δb*, $\Delta E^*ab=\{(\Delta L^*)^2+(\Delta a^*)^2+(\Delta b^*)^2\}^{1/2}$. Greater color difference indicates greater discoloration between before and after the test.

Measurement was done by using Minolta's color difference meter CR-200b and light source C.

The fluorine and carbon contents and oxide film thickness were derived from the composition distribution in the direction of depth determined by Auger electron spectroscopy.

Figure 3:
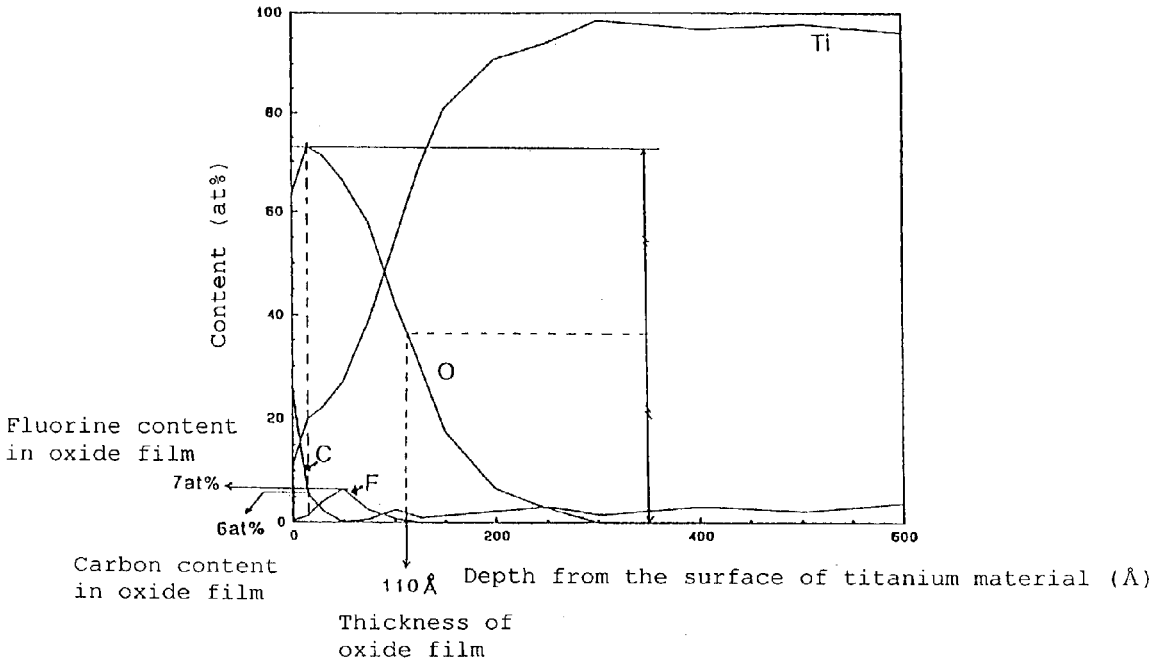
FIG. 3 shows an example of surface analysis results of titanium materials by Auger electron spectroscopy and methods of determining the oxide film thickness, fluorine and carbon contents according to this invention.

FIG. 3 shows an example of surface analysis results of titanium materials by Auger electron spectroscopy and methods of determining the oxide film thickness, fluorine and carbon contents according to this invention. The thickness of oxide film means a depth where the concentration of oxygen is intermediate between the maximum and base concentrations, and the maximum fluorine concentration in the oxide film is used as the fluorine concentration in the oxide film. Carbon concentration decreases substantially linearly in the direction of depth because of the influence of contamination at the outermost surface. The area where oxygen concentration at the outermost surface drops is considered to show the influence of contamination. Thus, the maximum carbon concentration found below the depth where oxygen concentration becomes maximum is used as the carbon content in the oxide film.

Measurement by Auger electron spectroscopy was carried out by using JEOL's Auger electron spectroscope JAMP-7100. In an analysis area of 50 μm, qualitative analysis of the outermost surface was performed using a broad spectrum. Composition distribution in the direction of depth was determined from the elements detected. Analysis in the direction of depth was performed by confirming the absence of other elements through quantitative analysis at intermediate depths. The analysis conditions for Auger electron spectroscopy described above are given just as an example and, therefore, the conditions are by no means limited thereto.

Figure 4:
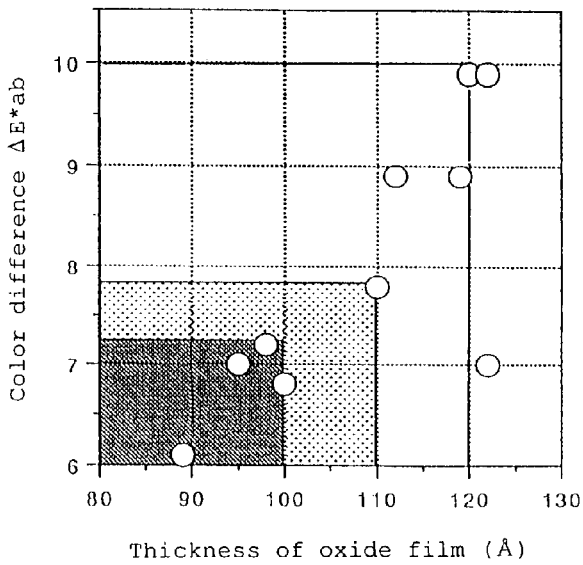
FIG. 4 shows the relationship between the oxide film thickness and the color difference ΔE*ab after accelerated discoloration test when the fluorine and carbon contents in the oxide film before the accelerated discoloration test are fixed within a certain range.

As can be seen from FIG. 3, the total fluorine and carbon contents in the oxide film increase as the thickness of the oxide film increases. This increase in fluorine and carbon contents sometimes affects resistance to discoloration. FIG. 4 shows the relationship between the oxide film thickness and the color difference ΔE*ab after the 7-day long accelerated discoloration test when the fluorine and carbon contents in the oxide film before the accelerated discoloration test are fixed within a certain range. FIG. 4 shows only the range where fluorine content is between 5 and 7 at % and carbon content is between 6 and 12 at % and discoloration is less likely to occur. Besides, acid concentration in the aqueous fluonitric acid solution is limited to between 50 and 80 g/l and the amount of surface reduction on one side to 10 μm.

Because the fluorine or carbon content in oxide film is in the range described in (1) and (2), oxide film thickness is not greater than approximately 120 angstrom and color difference is not greater than 10 points as shown in FIG. 4. Obviously, color difference decreases as oxide film thickness decreases, to as low as under 8 points when oxide film thickness is 110 angstrom or below.

Thus, this invention specifies oxide film thickness to be 120 angstrom or under, or preferably 110 angstrom, as described in (3) and (4).

Figure 5:
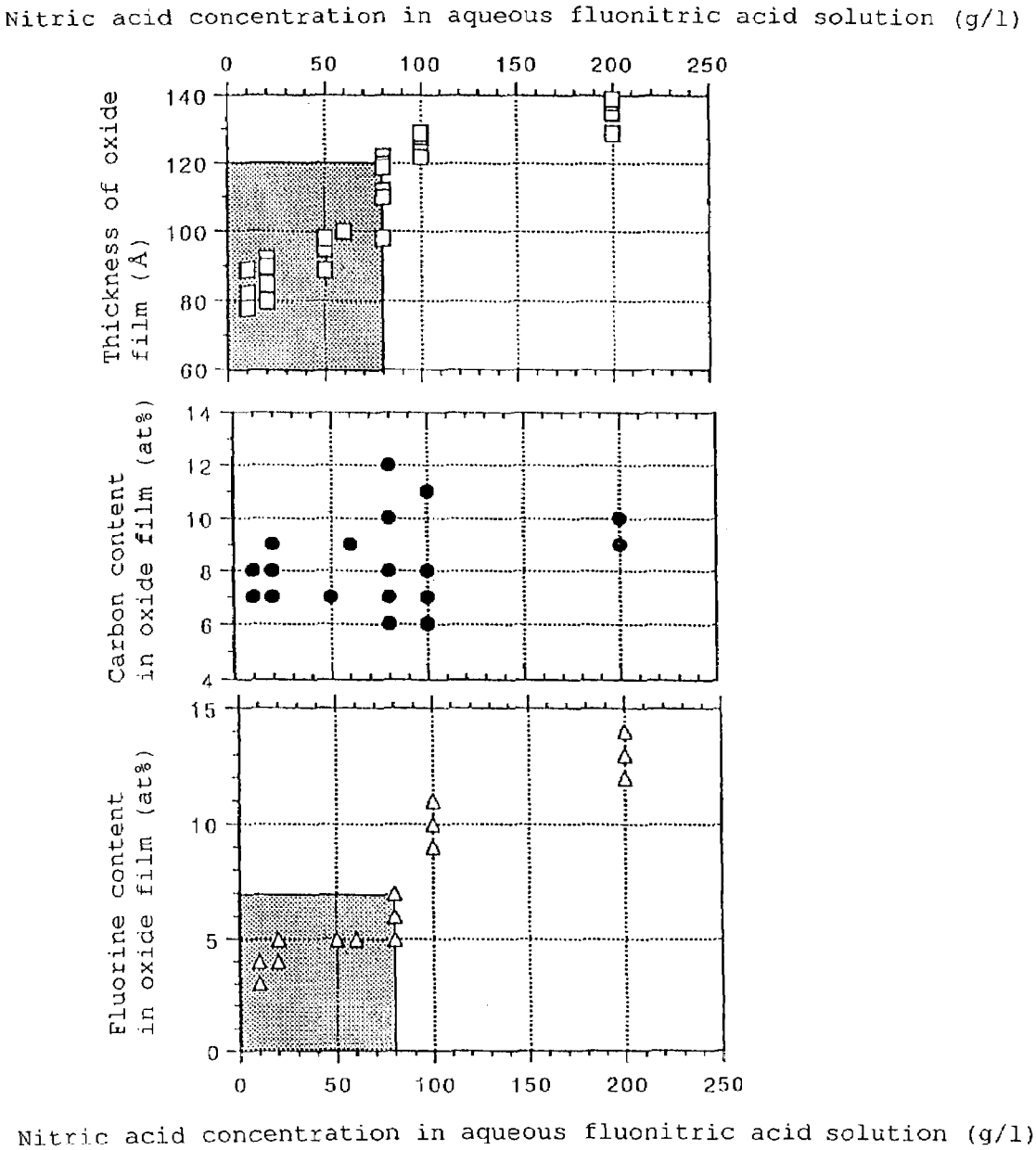
FIG. 5 shows the concentration of nitric acid in the aqueous solution of fluonitric acid and the relationship between the oxide film thickness and the fluorine content in the oxide film after being dissolved in the same aqueous solution.

Nitric acid concentration in the aqueous fluonitric acid solution affects the control of the thickness of the oxide film produced by dissolution in the aqueous fluonitric acid solution and the fluorine content in the oxide film. The inventors found, as shown in FIG. 5, that oxide films not greater than 120 angstrom in thickness and containing not more than 7 at % fluorine can be obtained by keeping the nitric acid concentration at not higher than 80 g/l (and the amount of titanium surface reduction on one side at not lower than 9 μm). Then, discoloration is difficult to occur.

When nitric acid concentration exceeds 80 g/l, the effect of nitric acid makes the surface of titanium more susceptible to passivation and increases the thickness of the oxide film, with resulting increase in fluorine content in the oxide film and susceptibility to discoloration. Therefore, this invention specifies that the surface of titanium materials should be dissolved by an aqueous fluonitric acid solution with a nitric acid concentration of 80 g/l or under, as described in (5). More preferably, this invention specifies nitric acid concentration to be in a range between 10 and 60 g/l as this range reduces the fluorine content in the oxide film to approximately 5 at % or under and the thickness of the oxide film to 100 angstrom or under.

FIG. 5 shows a case in which one side of titanium is dissolved by 9 μm or over in an aqueous fluonitric acid solution. When carbon content before dissolving is high and the amount of dissolving is extremely small, the carbon content in the oxide film after dissolving is sometimes relatively high. However, when the amount dissolved on one side exceeds 9 μm, the carbon content in the oxide film is immune to the effects of the composition and concentration of the aqueous fluonitric acid solution. The inventors also found that when titanium is dissolved in an aqueous fluonitric acid solution, fluorine in the oxide film is practically annihilated and the thickness of the oxide film reduced by heating the dissolved titanium in a vacuum or an atmosphere of inert gas, such as argon and helium, to a temperature of 300 to 900° C., as shown in FIG. 5. The inventors confirmed that titanium materials with highly pure stable oxide film containing as little impurities as possible other than oxygen are less susceptible to discoloration.

When the heating temperature is lower than 300° C., temperature is so low that diffusion and evaporation of fluorine, carbon and oxygen is delayed and the effect of heating is insufficient. When the heating temperature exceeds 900° C., temperature is so high that grain growth occurs in such a short time that material quality is sometimes impaired. When heat treatment is performed in the air or a nitriding atmosphere, titanium assumes a gold or blue color instead of a metallic color.

Therefore, this invention specifies that titanium materials whose surface is dissolved in an aqueous fluonitric acid solution should be heated to between 300 and 900° C. in a vacuum or in an inert-gas atmosphere such as argon and helium, as described earlier in (6). Preferably, the heating temperature should be between 400 and 700° C.

The condition of titanium materials before pickling described in (5) and (6) is not limited to any specific condition but may be either salt-immersed, heat-treated in a vacuum or an argon atmosphere or skinpass-rolled so long as dissolving in an acid solution is possible.

Whether skinpassing, abrasive blasting or other surface properties adjusting or redressing process is applied before or after dissolving in an aqueous fluonitric acid solution or before or after heat treatment in a vacuum or in an inert-gas atmosphere such as argon and helium, the effect of this invention to decrease susceptibility to discoloration remains substantially the same. In (5) and (6), therefore, this invention permits performing skinpassing, abrasive blasting or other surface properties adjusting or redressing process either before or after dissolving in an aqueous fluonitric acid solution or either before or after heat treatment in a vacuum or an atmosphere of such inert gas as argon and helium, as described in (7).

There are no limitations on the surface profile and material of rolls used for skinpass rolling and the shape and material of abrasives for blasting.

Though the description given so far centers on JIS Type 1 pure titanium for industrial use, this invention is not limited thereto but is also applicable to titanium alloys.

EXAMPLES

Now the effect of this invention will be described by reference to examples.

Table 1 shows manufacturing processes and conditions, oxide film thickness before accelerated discoloration test, fluorine and carbon contents in oxide film, and color difference ΔE*ab after a 7-day long accelerated discoloration test of JIS Type 1 pure titanium for industrial use. The oxide film thickness before the accelerated discoloration test, fluorine and carbon contents in the oxide film were determined, together with the composition distribution in the direction of depth determined by Auger electron spectroscopy, by the method described before.

TABLE 1

| No. | Manufacturing Process | Dissolving Condition in Aqueous Fluonitric Acid Solution | | | Heat Treatment Condition after | Surface Oxide Film before Accelerated Discoloration Test | | | Color Difference after 7-day | |
|---|---|---|---|---|---|---|---|---|---|---|
| | | Hydrofluoric Acid Concentration (g/l) | Nitric Acid Concentration (g/l) | dissolving on One Side (μm) | Dissolving in Aqueous Fluonitric Acid Solution | Oxide Film Tickness (Å) | Fluorine Content in Oxide Film (at %) | Carbon Content in Oxide Film (at %) | Accelerated Discoloration Test ΔE*ab | Re-marks |
| 1 | Cold rolling→rinsing→annealing in argon atmosphere | — | — | None | None | 95 | 0 | 8 | 6.1 | A |
| 2 | " | — | — | None | None | 125 | 0 | 18 | 8.8 | A |
| 3 | " | — | — | None | None | 129 | 0 | 25 | 10.0 | A |
| 4 | Cold rolling→rinsing→annealing in argon atmosphere→ dissolving in aqueous fluonitric acid solution | 10 | 80 | 2 | None | 122 | 5 | 12 | 7.0 | A |
| 5 | Cold rolling→rinsing→annealing in argon atmosphere→ dissolving in aqueous fluonitric acid solution | 20 | 10 | 10 | None | 82 | 4 | 8 | 4.5 | A |
| 6 | Cold rolling→rinsing→annealing in argon atmosphere→ dissolving in aqueous fluonitric acid solution | 20 | 20 | 11 | None | 84 | 4 | 7 | 5.8 | A |
| 7 | Cold rolling→rinsing→annealing in argon atmosphere→ dissolving in aqueous fluonitric acid solution | 20 | 20 | 5 | None | 90 | 5 | 9 | 5.3 | A |
| 8 | Cold rolling→rinsing→annealing in argon atmosphere→ dissolving in aqueous fluonitric acid solution | 20 | 20 | 2 | None | 92 | 5 | 17 | 6.6 | A |
| 9 | Cold rolling→rinsing→annealing in argon atmosphere→ dissolving in aqueous fluonitric acid solution | 20 | 50 | 10 | None | 95 | 5 | 7 | 7.0 | A |
| 10 | Cold rolling→rinsing→annealing in argon atmosphere→ dissolving in aqueous fluonitric acid solution | 20 | 80 | 11 | None | 110 | 7 | 6 | 7.8 | A |
| 11 | Cold rolling→rinsing→annealing in argon atmosphere→ dissolving in aqueous fluonitric acid solution | 20 | 100 | 11 | None | 122 | 9 | 7 | 14.6 | B |
| 12 | Cold rolling→rinsing→annealing in argon atmosphere→ dissolving in aqueous fluonitric acid solution | 35 | 50 | 10 | None | 98 | 5 | 7 | 6.9 | A |
| 13 | Cold rolling→rinsing→annealing in argon atmosphere→ dissolving in aqueous fluonitric acid solution | 35 | 80 | 11 | None | 98 | 6 | 7 | 7.2 | A |
| 14 | Cold rolling→rinsing→annealing in argon atmosphere→ dissolving in aqueous fluonitric acid solution | 35 | 100 | 11 | None | 129 | 10 | 8 | 13.5 | B |
| 15 | Cold rolling→rinsing→annealing in argon atmosphere→ dissolving in aqueous fluonitric acid solution | 35 | 200 | 10 | None | 135 | 13 | 9 | 22.3 | B |
| 16 | Cold rolling→rinsing→annealing in argon atmosphere→ dissolving in aqueous fluonitric acid solution | 50 | 10 | 1 | None | 89 | 2 | 22 | 9.6 | A |
| 17 | Cold rolling→rinsing→annealing in argon atmosphere→ dissolving in aqueous fluonitric acid solution | 50 | 10 | 9 | None | 78 | 3 | 7 | 5.2 | A |
| 18 | Cold rolling→rinsing→annealing in argon atmosphere→ dissolving in aqueous fluonitric acid solution | 50 | 20 | 10 | None | 80 | 4 | 8 | 4.9 | A |
| 19 | Cold rolling→rinsing→annealing in argon atmosphere→ dissolving in aqueous fluonitric acid solution | 50 | 50 | 11 | None | 89 | 5 | 7 | 6.1 | A |
| 20 | Cold rolling→rinsing→annealing in argon atmosphere→ dissolving in aqueous fluonitric acid solution | 50 | 60 | 10 | None | 100 | 5 | 9 | 6.8 | A |
| 21 | Cold rolling→rinsing→annealing in argon atmosphere→ dissolving in aqueous fluonitric acid solution | 50 | 80 | 10 | None | 122 | 7 | 10 | 9.9 | A |
| 22 | Cold rolling→rinsing→annealing in argon atmosphere→ dissolving in aqueous fluonitric acid solution | 50 | 80 | 1 | None | 120 | 7 | 22 | 9.9 | A |
| 23 | Cold rolling→rinsing→annealing in argon atmosphere→ dissolving in aqueous fluonitric acid solution | 50 | 100 | 10 | None | 125 | 10 | 11 | 15.2 | B |

TABLE 1-continued

| No. | Manufacturing Process | Dissolving Condition in Aqueous Fluonitric Acid Solution | | | Heat Treatment Condition after | Surface Oxide Film before Accelerated Discoloration Test | | | Color Difference after 7-day | |
|---|---|---|---|---|---|---|---|---|---|---|
| | | Hydrofluoric Acid Concentration (g/l) | Nitric Acid Concentration (g/l) | dissolving on One Side (μm) | Dissolving in Aqueous Fluonitric Acid Solution | Oxide Film Tickness (Å) | Fluorine Content in Oxide Film (at %) | Carbon Content in Oxide Film (at %) | Accelerated Discoloration Test ΔE*ab | Re-marks |
| 24 | Cold rolling→rinsing→annealing in argon atmosphere→dissolving in aqueous fluonitric acid solution | 50 | 200 | 11 | None | 138 | 14 | 9 | 19.8 | B |
| 25 | Cold rolling→rinsing→annealing in argon atmosphere→dissolving in aqueous fluonitric acid solution | 50 | 200 | 2 | None | 129 | 12 | 22 | 25.0 | B |
| 26 | Cold rolling→rinsing→annealing in the atmosphere→salt immersion→dissolving in aqueous fluonitric acid solution | 20 | 20 | 15 | None | 90 | 5 | 9 | 5.5 | A |
| 27 | Cold rolling→rinsing→annealing in the atmosphere→salt immersion→dissolving in aqueous fluonitric acid solution | 20 | 80 | 16 | None | 112 | 7 | 8 | 8.9 | A |
| 28 | Cold rolling→rinsing→annealing in the atmosphere→salt immersion→dissolving in aqueous fluonitric acid solution | 20 | 100 | 13 | None | 129 | 11 | 8 | 14.9 | B |
| 29 | Cold rolling→rinsing→annealing in the atmosphere→salt immersion→dissolving in aqueous fluonitric acid solution | 50 | 20 | 15 | None | 85 | 5 | 9 | 6.0 | A |
| 30 | Cold rolling→rinsing→annealing in the atmosphere→salt immersion→dissolving in aqueous fluonitric acid solution | 50 | 80 | 16 | None | 119 | 7 | 8 | 8.9 | A |
| 31 | Cold rolling→rinsing→annealing in the atmosphere→salt immersion→dissolving in aqueous fluonitric acid solution | 50 | 100 | 15 | None | 128 | 10 | 6 | 16.8 | B |
| 32 | Cold rolling→rinsing→annealing in the atmosphere→salt immersion→dissolving in aqueous fluonitric acid solution | 50 | 200 | 14 | None | 139 | 12 | 10 | 18.9 | B |
| 33 | Cold rolling→rinsing→annealing in argon atmosphere→dissolving in aqueous fluonitric acid solution→heat treatment in argon atmosphere | 50 | 10 | 1 | 600° C., 1 hour | 87 | 1 | 25 | 9.5 | A |
| 34 | Cold rolling→rinsing→annealing in argon atmosphere→dissolving in aqueous fluonitric acid solution→heat treatment in argon atmosphere | 50 | 10 | 10 | 600° C., 1 hour | 80 | 0 | 15 | 5.8 | A |
| 35 | Cold rolling→rinsing→annealing in argon atmosphere→dissolving in aqueous fluonitric acid solution→heat treatment in argon atmosphere | 50 | 200 | 11 | 200° C., 4 hours | 100 | 8 | 15 | 14.4 | B |
| 36 | Cold rolling→rinsing→annealing in argon atmosphere→dissolving in aqueous fluonitric acid solution→heat treatment in argon atmosphere | 50 | 200 | 11 | 300° C., 4 hours | 79 | 3 | 17 | 6.9 | A |
| 37 | Cold rolling→rinsing→annealing in argon atmosphere→dissolving in aqueous fluonitric acid solution→heat treatment in argon atmosphere | 50 | 200 | 11 | 600° C., 1 hour | 82 | 2 | 19 | 5.0 | A |

TABLE 1-continued

| No. | Manufacturing Process | Dissolving Condition in Aqueous Fluonitric Acid Solution | | | Heat Treatment Condition after | Surface Oxide Film before Accelerated Discoloration Test | | | Color Difference after 7-day | |
|---|---|---|---|---|---|---|---|---|---|---|
| | | Hydrofluoric Acid Concentration (g/l) | Nitric Acid Concentration (g/l) | dissolving on One Side (μm) | Dissolving in Aqueous Fluonitric Acid Solution | Oxide Film Tickness (Å) | Fluorine Content in Oxide Film (at %) | Carbon Content in Oxide Film (at %) | Accelerated Discoloration Test ΔE*ab | Re-marks |
| 38 | Cold rolling→rinsing→annealing in argon atmosphere→ dissolving in aqueous fluonitric acid solution→ heat treatment in argon atmosphere | 50 | 200 | 11 | 700° C.. 1 hour | 84 | 0 | 15 | 4.8 | A |
| 39 | Cold rolling→rinsing→annealing in argon atmosphere→ dissolving in aqueous fluonitric acid solution→ heat treatment in argon atmosphere | 50 | 200 | 11 | 800° C., 30 minutes | 85 | 1 | 14 | 5.5 | A |
| 40 | Cold rolling→rinsing→annealing in argon atmosphere→ dissolving in aqueous fluonitric acid solution→ heat treatment in argon atmosphere | 50 | 200 | 11 | 900° C., 30 minutes | 92 | 0 | 17 | 6.1 | A |
| 41 | Cold rolling→rinsing→annealing in argon atmosphere→ dissolving in aqueous fluonitric acid solution→ heat treatment in helium atmosphere | 50 | 200 | 11 | 600° C., 1 hour | 85 | 2 | 14 | 6.1 | A |
| 42 | Cold rolling→rinsing→annealing in argon atmosphere→ dissolving in aqueous fluonitric acid solution→ heat treatment in vacuum | 50 | 200 | 11 | 600° C.. 1 hour | 85 | 0 | 15 | 6.2 | A |

A: Example of this invention
B: Example for comparison

Examples for comparison Nos. 11, 14, 15, 23 to 25, 28, 31, 32 and 35 in Table 1 contained more than 8 at % fluorine in the oxide film, had thick oxide films with thickness exceeding 120 angstrom, had as high a carbon content as 22 at %, showed as high a color difference as approximately 14 points or above after the accelerated discoloration test, and were obviously discolored.

The above is due to the thick oxide film resulted from the nitric acid concentration in the aqueous fluonitric acid solution used for dissolving that was as high as over 100 g/l and raised the fluorine or carbon content incorporated therein. Example No. 35 was heat treated in an argon atmosphere after the surface had been dissolved in an aqueous solution of fluonitric acid. Although the oxide film became as thin as 100 angstrom, fluorine content in the oxide film did not decrease sufficiently because the heat treatment was performed at as low a temperature as 200° C. As a consequence, color difference was as great as 14.4 points.

By contrast, examples according to this invention Nos. 1 to 10, 12, 13, 17 to 20, 26, 27, 29, 30, 33, 34 and 36 to 42 contained less impurity in the oxide film. Fluorine and carbon contents were 7 at % or under and 20 at % or under, respectively. Besides, oxide film thickness was not greater than 120 angstrom. Examples Nos. 16, 21 and 22 were according to claims 1 and 2. Oxide film thickness was not less than 120 angstrom and carbon content in oxide film was not less than 20 at %. As color difference after the accelerated discoloration test was not greater than 10 points, these examples were obviously less susceptible to discoloration. It is also obvious that oxide films containing less fluorine and carbon give smaller color difference.

This is due to the dissolving in an aqueous fluonitric acid solution with a fluoric acid concentration of 80 g/l or under that produces relatively thin oxide film and reduces the fluorine content incorporated therein. Examples Nos. 34 and 36 to 42 were dissolved in an aqueous fluonitric acid solution and heat-treated in a vacuum or an atmosphere of argon or helium at 300 to 900° C. This reduced the thickness of oxide film and the content of fluorine therein. Under some conditions, fluorine content was too low to be detected and, therefore, the surface was stable and color difference was small.

Table 2 shows manufacturing processes and conditions, oxide film thickness before accelerated discoloration test, fluorine and carbon contents in oxide film, and color difference $\Delta E^*ab$ after a 7-day long accelerated discoloration test of JIS Type 1 pure titanium for industrial use subjected to skinpass rolling and alumina blasting. The oxide film thickness before the accelerated discoloration test, fluorine and carbon contents in the oxide film were determined, together with the composition distribution in the direction of depth determined by Auger electron spectroscopy, by the method described before, as with the data given in Table 1.

TABLE 2

| No. | Manufacturing Process | Dissolving Condition in Aqueous Fluonitric Acid Solution | | | Heat Treatment Condition after | Surface Oxide Film before Accelerated Discoloration Test | | | Color Difference after 7-day | |
|---|---|---|---|---|---|---|---|---|---|---|
| | | Hydrofluoric Acid Concentration (g/l) | Nitric Acid Concentration (g/l) | Dissolving on One Side (μm) | Dissolving in Aqueous Fluonitric Acid Solution | Oxide Film Tickness (Å) | Fluorine Content in Oxide Film (at %) | Carbon Content in Oxide Film (at %) | Accelerated Discoloration Test ΔE*ab | Re-marks |
| 43 | Cold rolling→rinsing→annealing in argon atmosphere→ dissolving in aqueous fluonitric acid solution→ skinpass rolling | 20 | 20 | 11 | None | 92 | 3 | 8 | 6.2 | A |
| 44 | Cold rolling→rinsing→annealing in argon atmosphere→ dissolving in aqueous fluonitric acid solution→ skinpass rolling | 20 | 50 | 10 | None | 100 | 4 | 9 | 6.9 | A |
| 45 | Cold rolling→rinsing→annealing in argon atmosphere→ dissolving in aqueous fluonitric acid solution→ skinpass rolling | 20 | 80 | 11 | None | 109 | 7 | 7 | 9.8 | A |
| 46 | Cold rolling→rinsing→annealing in argon atmosphere→ dissolving in aqueous fluonitric acid solution→ skinpass rolling | 20 | 100 | 11 | None | 120 | 10 | 9 | 13.0 | B |
| 47 | Cold rolling→rinsing→annealing in argon atmosphere→ dissolving in aqueous fluonitric acid solution→ skinpass rolling | 50 | 20 | 10 | None | 78 | 4 | 10 | 4.9 | A |
| 48 | Cold rolling→rinsing→annealing in argon atmosphere→ dissolving in aqueous fluonitric acid solution→ skinpass rolling | 50 | 50 | 11 | None | 85 | 5 | 7 | 6.5 | A |
| 49 | Cold rolling→rinsing→annealing in argon atmosphere→ dissolving in aqueous fluonitric acid solution→ skinpass rolling | 50 | 80 | 10 | None | 124 | 6 | 9 | 9.8 | A |
| 50 | Cold rolling→rinsing→annealing in argon atmosphere→ dissolving in aqueous fluonitric acid solution→ skinpass rolling | 50 | 100 | 10 | None | 128 | 11 | 8 | 14.3 | B |
| 51 | Cold rolling→rinsing→annealing in argon atmosphere→ dissolving in aqueous fluonitric acid solution→ skinpass rolling | 50 | 200 | 11 | None | 129 | 12 | 9 | 20.0 | B |
| 52 | Cold rolling→rinsing→annealing in argon atmosphere→ dissolving in aqueous fluonitric acid solution→ alumina blasting | 20 | 50 | 10 | None | 115 | 0 | 10 | 6.0 | A |
| 53 | Cold rolling→rinsing→annealing in argon atmosphere→ dissolving in aqueous fluonitric acid solution→ alumina blasting | 50 | 50 | 11 | None | 118 | 0 | 12 | 6.2 | A |
| 54 | Cold rolling→rinsing→annealing in argon atmosphere→ skinpass rolling→dissolving in aqueous fluonitric acid solution | 20 | 50 | 9 | None | 100 | 5 | 9 | 5.3 | A |
| 55 | Cold rolling→rinsing→annealing in argon atmosphere→ skinpass rolling→dissolving in aqueous fluonitric acid solution | 50 | 20 | 11 | None | 85 | 5 | 10 | 6.8 | A |

TABLE 2-continued

| No. | Manufacturing Process | Dissolving Condition in Aqueous Fluonitric Acid Solution | | | Heat Treatment Condition after | Surface Oxide Film before Accelerated Discoloration Test | | | Color Difference after 7-day | |
|---|---|---|---|---|---|---|---|---|---|---|
| | | Hydrofluoric Acid Concentration (g/l) | Nitric Acid Concentration (g/l) | Dissolving on One Side (μm) | Dissolving in Aqueous Fluonitric Acid Solution | Oxide Film Tickness (Å) | Fluorine Content in Oxide Film (at %) | Carbon Content in Oxide Film (at %) | Accelerated Discoloration Test ΔE*ab | Re-marks |
| 56 | Cold rolling→rinsing→annealing in argon atmosphere→skinpass rolling→dissolving in aqueous fluonitric acid solution | 50 | 80 | 9 | None | 112 | 7 | 10 | 6.6 | A |
| 57 | Cold rolling→rinsing→annealing in argon atmosphere→dissolving in aqueous fluonitric acid solution→heat treatment in argon atmosphere→skinpass rolling | 50 | 50 | 11 | 600° C., 1 hour | 92 | 0 | 16 | 5.1 | A |
| 58 | Cold rolling→rinsing→annealing in argon atmosphere→dissolving in aqueous fluonitric acid solution→skinpass rolling→heat treatment in argon atmosphere | 50 | 200 | 11 | 600° C., 1 hour | 85 | 0 | 15 | 4.9 | A |

A: Example of this invention
B: Example for comparison

Examples for comparison Nos. 46, 50 and 51 in Table 2 were dissolved in an aqueous fluonitric acid solution with a nitric acid of 100 g/l or over and then skinpass rolled. Fluorine and carbon contents in the oxide film remained substantially unchanged from before the application of skinpass rolling, as in the case of Examples Nos. 11, 23 and 24 in Table 1. Fluorine content in the oxide film was as high as 10 at % or above, as a result of which color difference was as great as 13 points or above.

Examples Nos. 43 to 45, 47 to 49, and 54 to 56 according to this invention were dissolved in an aqueous fluonitric acid solution with a nitric acid concentration of 80 g/l or under. Even if skinpass rolling was applied before or after dissolving, fluorine and carbon contents in the surface oxide film remained substantially unchanged. Fluorine content was as low as 7 at % or below and color difference was as small as under 10 points, as with the examples dissolved in an aqueous fluonitric acid solution shown in Table 1. Thus, the degree of insusceptibility to discoloration remained substantially the same when dissolving was performed in an aqueous fluonitric acid with a nitric acid concentration of 80 g/l or under, whether skinpass rolling was applied before or after dissolving.

Examples Nos. 52 and 53 were subjected to alumina blasting after being dissolved in an aqueous fluonitric acid solution. With the surface thus slightly reduced, fluorine content was lowered to an undetectable level, as a result of which color difference was also reduced to as low as 6.2 points or under. Thus, the degree of insusceptibility to discoloration remained substantially the same when dissolving was performed in an aqueous fluonitric acid with a nitric acid concentration of 80 g/l or under, whether alumina blasting, like skinpass rolling, was applied before or after melting.

Examples Nos. 57 and 58 according to this invention were subjected to skinpass rolling before and after heat treatment in an argon atmosphere. No fluorine was detected in the oxide film of both examples and color difference was as small as approximately 5.0 points. Obviously, the degree of insusceptibility to discoloration remained unchanged whether skinpass rolling was applied before or after the heat treatment in an argon atmosphere. Like the skinpass rolling described here, alumina blasting or redressing also produces similar results.

While the examples of this invention described are JIS Type 1 pure titanium for industrial use, similar results are obtainable for other types of pure titanium and titanium alloys.

INDUSTRIAL APPLICABILITY

As is obvious from the above, titanium materials less susceptible to discoloration are obtainable by controlling fluorine and carbon contents in the oxide film on the surface of titanium and the thickness thereof. The titanium materials thus obtained are useful particularly for building roofs, walls and other exterior materials that should not be unpleasant or offensive to view.

What is claimed is:

1. A method of manufacturing titanium material less susceptible to discoloration comprising annealing the titanium material prior to dissolving the surface of the titanium material in an aqueous solution of hydrofluoric and nitric acids; and thereafter, heating the titanium material at between 300 and 900° C. in a vacuum or an inert gas atmosphere after dissolving the surface of the titanium material in the aqueous solution of hydrofluoric and nitric acids;

thereby providing the titanium material having an oxide film not more than 100 angstrom in thickness on the surface thereof containing not more than 3 at % fluorine and not more than 20 at % carbon in said oxide film.

2. A method of manufacturing titanium material less susceptible to discoloration according to claim 1 comprising applying skin pass rolling, shot blasting or other surface properties adjusting or redressing either before or after, or both, dissolving in an aqueous fluonitric acid solution or either before or after, or both, heat treating in the vacuum or the inert gas atmosphere of argon or helium.

* * * * *

UNITED STATES PATENT AND TRADEMARK OFFICE

CERTIFICATE OF CORRECTION

PATENT NO. : 7,594,973 B2
APPLICATION NO. : 10/343168
DATED : September 29, 2009
INVENTOR(S) : Kazuhiro Takahashi et al.

It is certified that error appears in the above-identified patent and that said Letters Patent is hereby corrected as shown below:

Page 3, figure 5, change “fluonitric” to --fluoronitric--;

Column 1, line 51, change “fluonitric” to --fluoronitric--;

Column 2, line 36, change “fluonitric” to --fluoronitric--;

Column 2, line 43, change “300 and” to --300°C and--;

Column 2, line 48, change “fluonitric” to --fluoronitric--;

Column 3, line 13, change “fluonitric” to --fluoronitric--;

Column 3, line 35, change “pH3” to --pH 3--;

Column 4, line 2, change “fluoric acid” to --hydrofluoric acid--;

Column 4, line 45, change “pH3” to --pH 3--;

Column 5, line 29, change “fluonitric” to --fluoronitric--;

Column 5, line 42, change “fluonitric” to --fluoronitric--;

Column 5, line 44, change “fluonitric” to --fluoronitric--;

Column 5, line 58, change “fluonitric” to --fluoronitric--;

Column 5, line 66, change “fluonitric” to --fluoronitric--;

Column 6, line 6, change “fluonitric” to --fluoronitric--;

Column 6, line 7, change “fluonitric” to --fluoronitric--;

Column 6, line 37, change “fluonitric” to --fluoronitric--;

Column 6, line 44, change “fluonitric” to --fluoronitric--;

Column 7, Table 1, change “fluonitric” to --fluoronitric--; (22 occurrences)

Column 9, Table 1, change “fluonitric” to -- fluoronitric--; (16 occurrences)

Column 11, Table 1, change “fluonitric” to --fluoronitric--; (7 occurrences)

Column 13, line 9, change “fluonitric” to --fluoronitric--;

Column 13, line 14, change “fluonitric” to --fluoronitric--;

Column 14, line 7, change “fluoric acid” to --hydrogen fluoride--;

Column 14, line 10, change “fluonitric” to --fluoronitric--;

Column 19, line 2, change “fluonitric” to --fluoronitric--;

Column 19, line 11, change “fluonitric” to --fluoronitric--;

Column 19, line 18, change “fluonitric” to --fluoronitric--;

Column 19, line 20, change “fluonitric” to --fluoronitric--;

Column 19, line 25, change “fluonitric” to --fluoronitric--;

Column 19, line 31, change “fluonitric” to --fluoronitric--;

Column 20, line 24, change “300” to --300°C--; and

Column 20, line 36, change “fluonitric” to --fluoronitric--.

Signed and Sealed this

Sixteenth Day of March, 2010

David J. Kappos

David J. Kappos
*Director of the United States Patent and Trademark Office*